United States Patent [19]

Ferguson

[11] Patent Number: 5,005,779

[45] Date of Patent: Apr. 9, 1991

[54] SYSTEM FOR DISPENSING A CONTINUOUS WEB FROM A ROLL ON WHICH THE WEB IS WOUND

[75] Inventor: Gregory A. Ferguson, New Bedford, Mass.

[73] Assignee: Precision Handling Devices, Rochester, N.Y.

[21] Appl. No.: 446,946

[22] Filed: Dec. 4, 1989

[51] Int. Cl.[5] ..... B65H 23/16; B65H 18/20

[52] U.S. Cl. ..... 242/68.7; 24/75.3; 24/75.43

[58] Field of Search ..... 242/55.2, 55, 68.7, 242/75.3, 67.4, 67.3, 75.4, 75.42, 75.43

[56] References Cited

U.S. PATENT DOCUMENTS

| | | | |
|---|---|---|---|
| 573,229 | 12/1896 | Metz | 242/68.7 |
| 1,773,743 | 7/1927 | Moore | 242/75.3 |
| 1,825,782 | 10/1931 | Duff | 242/55.2 |
| 1,973,354 | 9/1934 | Nedberg | 242/55.2 X |
| 2,205,198 | 6/1938 | Hope | 242/55.2 |
| 2,649,256 | 8/1953 | Skrebba | 242/55.2 |
| 2,957,638 | 10/1960 | Schiller et al. | 242/68.7 |
| 3,582,010 | 6/1971 | Whiteman | 242/68.7 X |
| 3,684,205 | 8/1972 | Rogow | 242/75.3 X |
| 4,345,708 | 8/1982 | Hubbard | 226/75 X |

FOREIGN PATENT DOCUMENTS

| | | | |
|---|---|---|---|
| 687701 | 2/1940 | Fed. Rep. of Germany . | |
| 170357 | 10/1982 | Japan | 242/55.2 |
| 669323 | 3/1989 | Switzerland | 242/55.2 |

*Primary Examiner*—William A. Cuchlinski, Jr.
*Assistant Examiner*—Joseph A. Rhoa
*Attorney, Agent, or Firm*—Martin LuKacher

[57] ABSTRACT

Continuous web material, particularly perforated paper from a roll is dispensed by a system installed, for example, in a computer printer. The system utilizes a roller which is fixed in a frame. The roll of paper has a central opening. The roll is supported on a shaft of diameter smaller than the diameter of the opening. The roll rests on the roller and is supported so that it can pivot and move up and down toward and away from the roller. This support is provided by slots in walls of the frame between which the roll is located and which receive the opposite ends of the shaft and guide the shaft. When the paper is pulled (unwound) from the roll, as by tractors when the paper is edge perforated, the roll climbs along the periphery of the cylindrical roller. The pivotal movement is limited by the walls of the slot and the shaft. When the pull on the paper stops, the roll falls down along the periphery of the roller and rotates in the opposite direction from that in which the paper is pulled from the roll (i.e., the roll backs up) thereby applying back tension to the paper between the tractor and the roll and maintaining the paper tight. The paper is pulled and unreeled from approximately the point of contact of the roll (at the outer turn of the paper) and the cylindrical roller along a straight path generally aligned with the gap between the lid and body of the tractor.

10 Claims, 4 Drawing Sheets

SYSTEM FOR DISPENSING A CONTINUOUS WEB FROM A ROLL ON WHICH THE WEB IS WOUND

Figure 1:
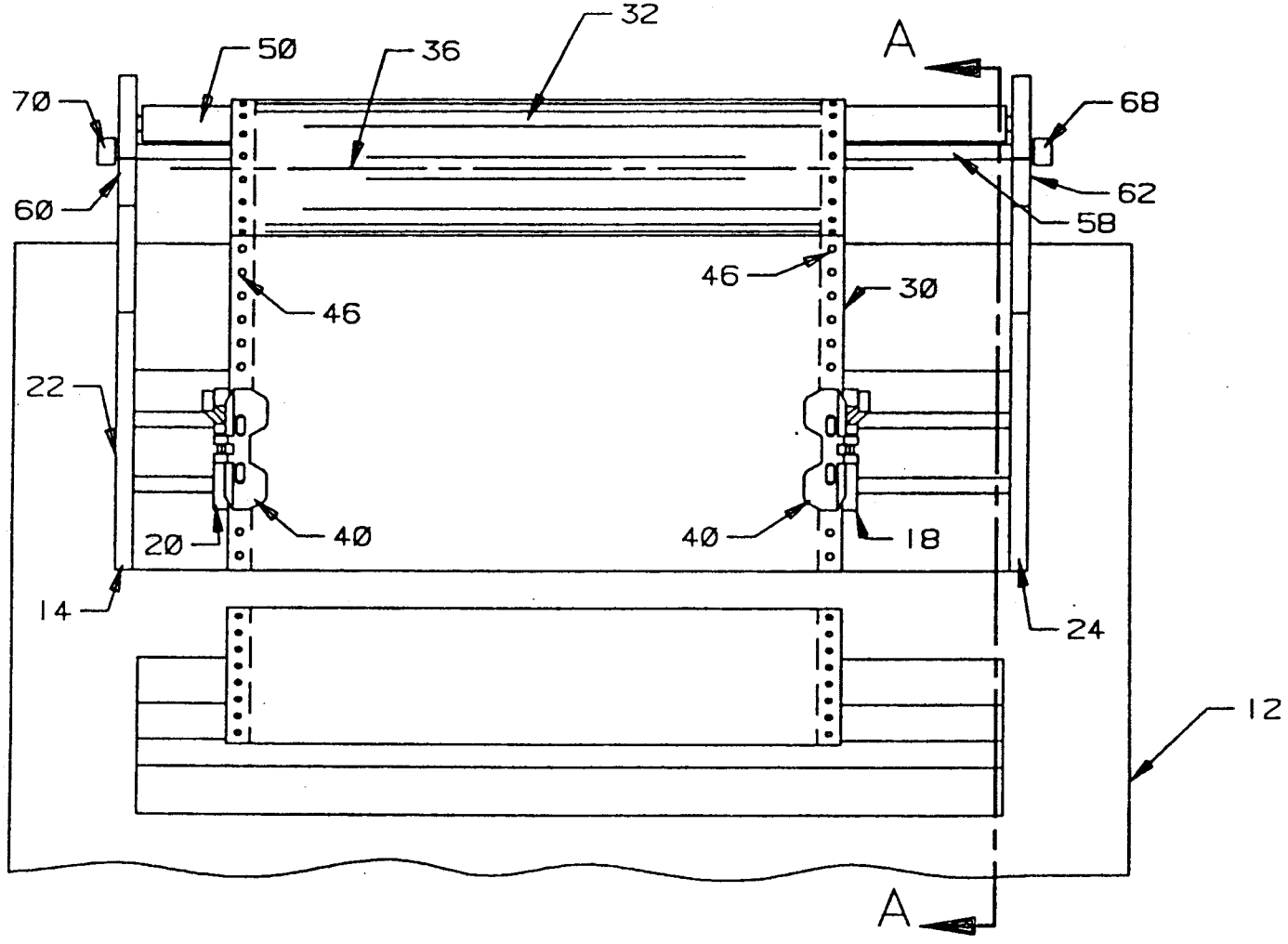

The present invention provides a system (method and apparatus) for dispensing a web wound in a roll which provides, automatically, pull back and back tension forces on the web when unreeling stops.

The invention is especially suitable for use in computer printers wherein it is desirable to use webs (paper) on which continuous forms may be printed and which is wound in a roll rather than fan folded. The invention will be found useful wherever it is desired to dispense webs by unwinding or unreeling them from a roll.

In computer printers and other apparatus using webs which must be unwound from a roll, the webs are pulled from the roll intermittently, the web movement starting, causing the paper to be accelerated, and decelerating and stopping when the pull on paper is released. During deceleration, the roll tends to continue turning. This affect is called "overspin" and can result in the spewing of the paper between the form and the infeeding devices, out onto the floor or into the works of the printer. Many computer printers which utilize edge perforated paper use tractors as their infeeding device and feed the paper intermittently so that successive lines can be printed. When the paper is not in tension between the infeeding devices and the roll, the load on the devices can change abruptly causing failures in the devices. In addition, the excess paper which is spewed out when overspin occurs, can cause jams in the infeeding devices. Another problem in dispensing paper and other webs from rolls is that the angle of the paper between the roll and the infeeding devices changes as the diameter of the roll decreases due to the unreeling of more and more paper therefrom. Many infeeding devices, such as tractors are sensitive to the angle between the paper and the path of the paper through the tractors. This path is usually defined by the gap between the body of the tractor and the lid through which the pins on the tractor belt extend through the perforations in the paper. For large deviations from parallelism the paper may drag on the lid or body of the tractor which affects the feed of the paper and contributes to paper jams.

Various techniques have been proposed to counteract roll overspin and maintain back tension forces on the paper. These have involved rollers which engage the paper between the roll and the infeeding device or weights which drag on the roll so as to establish fictional forces between the roll and a roller on which the roll rests. Floating and fixed drag rollers are shown in U.S. Pat. Nos. 1,773,447 and 573,229, respectively. Tensioning arms are shown in German patent 687,701 of Feb. 3, 1940. These techniques are disadvantageous in that they generate additional drag and load on the infeeding devices. They also make it difficult to install and replace exhausted rolls with fresh rolls.

It is the principal object of the present invention to provide an improved system for web dispensing which automatically prevents overspin when pulling forces in a direction to unreel the web from a roll are released.

It is another object of the present invention to provide an improved system for unreeling or unwinding a web from a roll which maintains an essentially straight path of the web between the roll and the infeeding device.

It is a still further object of the present invention to provide an improved system for unwinding and unreeling a web from a roll which makes it simple to assemble the roll on, or replace the roll with a fresh roll in, apparatus such as a printing machine, computer printer or other continuous web utilizing apparatus.

Briefly described, apparatus for unwinding a web wound into a roll which is provided in accordance with the invention makes use of the central opening along the axis of the roll. A rotatable body (for example, a cylindrical roller) on which the roll rests rotates with the roll. The roll and roller rotate, both when paper is pulled from the roll and after the pulling forces are released but in opposite senses thereby maintaining tension in the web between the roll and an infeeding device and avoiding the adverse affects of overspin. Means are provided for supporting the roll for limited combined pivotal and translational movement about the roller which is mounted in a frame for rotation about a fixed axis. The infeeding device provides pulling forces in one direction to the web to unwind the web. This causes the roll to climb a distance along the roller while the roll executes pivotal and translational movements in an upward direction. This movement is limited by the supporting means, which may be provided by slots in opposite walls of the frame in which a shaft of diameter smaller than the diameter of the central opening in the roll is located. This shaft extends through the central opening in the roll. When the roll is in a static position, it is disposed lower along the cylindrical roller than when it is in its dynamic position with pulling forces applied. The center of gravity of the roll is offset from the point where the roll contacts the roller. The roll, therefore, climbs along the periphery of the roller as it moves from the static position to the dynamic position, as the paper is accelerated. In other words the roll responds to the acceleration by overcoming its mass and rotating about the center of the roller and about its own center. In rotating the roll pivots and climbs or moves upwardly. When the movement of the web is decelerated (the pulling force being released), the weight of the roll and the force applied to the roll is out of balance; i.e., the dynamic state is unstable. The center of gravity of the roll shifts, and the roll rotates in the opposite direction from which it was rotating in response to the pulling forces. This rotation is a backspin which applies a backtension to the web, automatically maintaining the tension in the web between the roll and the infeeding device. Also in the dynamic position, the web is fed approximately tangent to the roll where it contacts the roller which provides a generally straight path to the infeeding device which avoids jams when the infeeding device is a forms feeding tractor.

Figure 2:
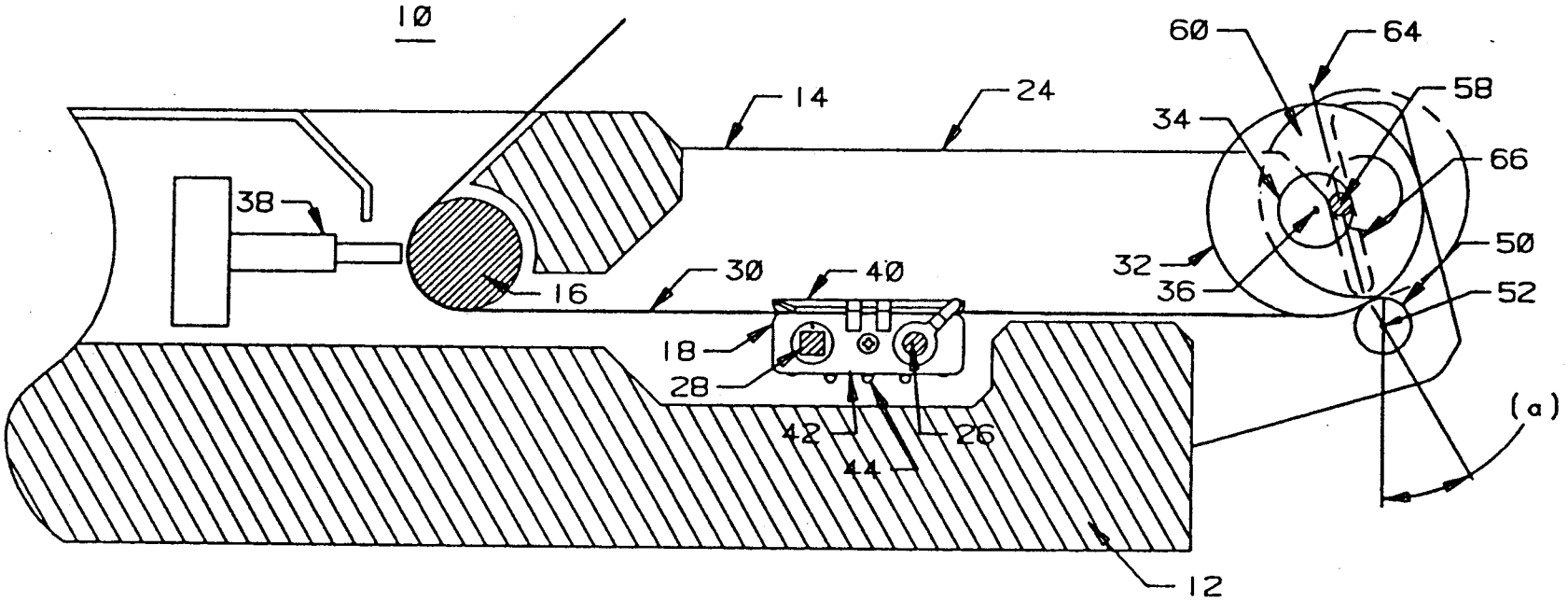
Figure 3:
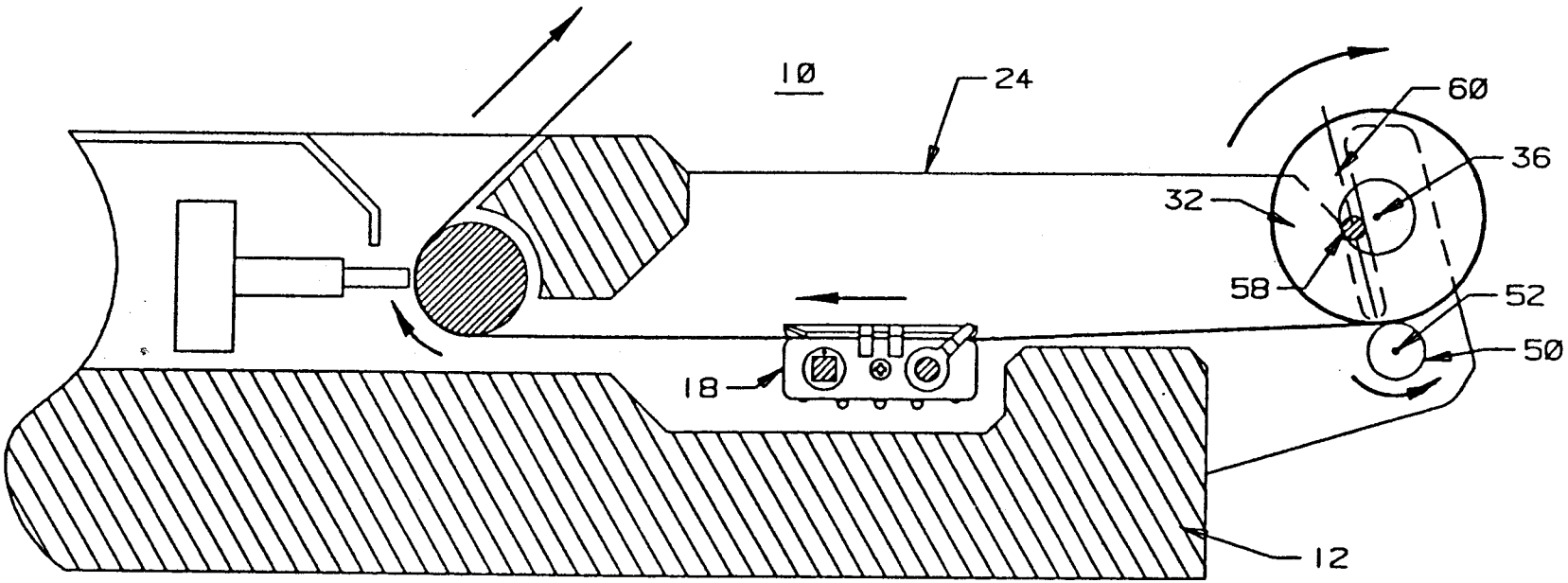
Figure 4:
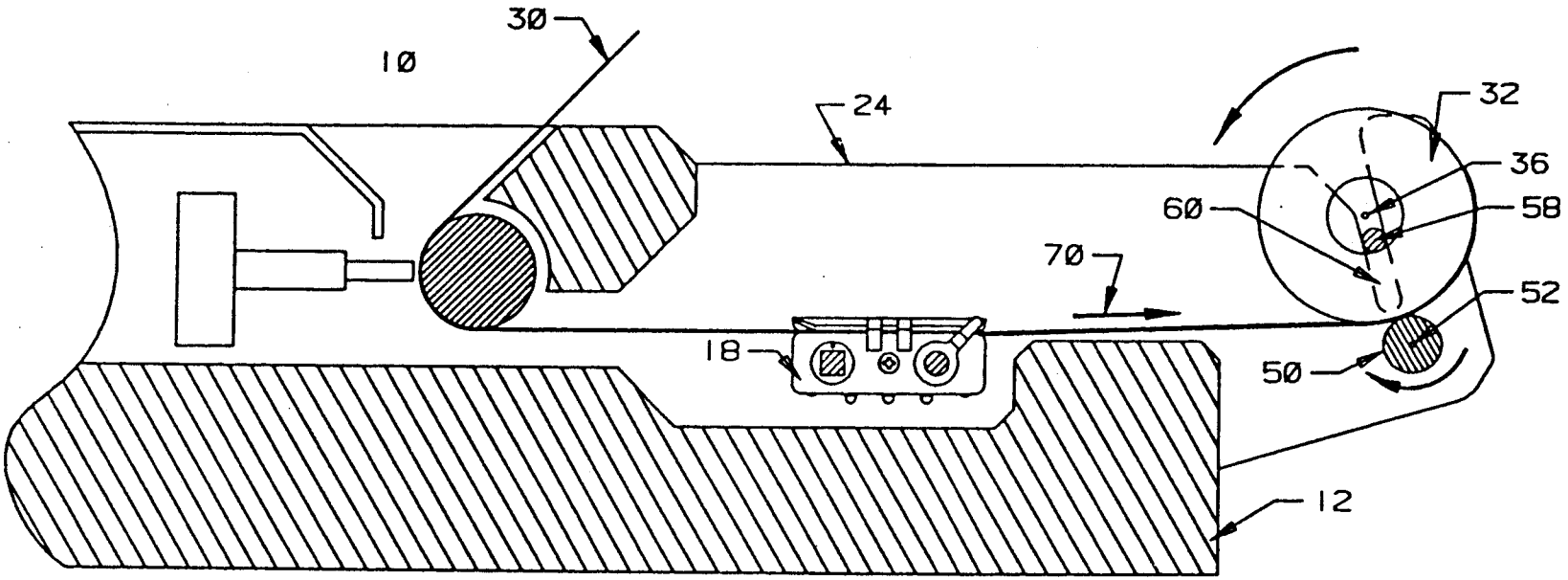

The foregoing and other objects, features and advantages of the invention will become more apparent from a reading of the following description in connection with the accompanying drawings in which:

FIG. 1 is a plan view, diagrammatically illustrating a computer printer incorporating a paper roll dispensing system embodying the invention; and FIGS. 2, 3 and 4 are sectional views taken along the line A—A in FIG. 1, which diagrammatically illustrate the dispensing system with the roll in its static position, in its dynamic position and after pulling forces on the paper have stopped, between static and dynamic positions, respectively.

Referring to the drawings there is shown a printer 10 having a base plate 12 and a frame 14. A platen roller 16 is rotatably mounted in the frame 14. A pair of computer forms feeding tractors 18 and 20 are mounted between opposite walls 22 and 24 of the frame 14 on a support shaft 26 and a drive shaft 28. The platen roller 16 and drive shaft 28 are intermittently driven by a drive mechanism (not shown) This feeds an edge perforated continuous paper web 30 from a roll 32 on which the web is wound. The roll 32 has a central opening 34 and an axis of rotation 36 which is along its center of gravity. For further information respecting forms feed tractors, reference may be had to U.S. Pat. Nos. 3,825,162 issued July 23, 1974 and 4,611,737 issued Sept. 16, 1986. For tractor/platen roller drives reference may be had to U.S. Pat. No. 4,345,708 issued Aug. 24, 1982 and/or 4,616,773 issued Oct. 14, 1986.

A print hammer mechanism 38 impacts the paper 30 and prints characters or other indicia along lines across the width of the paper; the line spacing being provided by the incremental displacement of the paper 30 by the platen roller 16 and tractors 18 and 20.

The tractors have a lid 40 and a body 42. The tractors 18 & 20 also have a belt from which pins 44 extend into the perforations 46 along opposite edges of the paper 30. The paper travels along a path through a gap between the lid 40 and the body 42 where the pins 44 extend through and engage the perforations 46. While a tractor is shown as the infeeding device other infeeding devices such as pin wheels and pinch rollers (in the case of unperforated paper) may be used.

The dispensing system utilizes a cylindrical roller 50 which is wider than the roll 32 and is journalled in bearings (not shown) in the walls 22 and 24 of the frame 14. The roller 50 may be a cylinder of elastomeric material such as rubber. The roll 32 rests on the roller but makes contact in different locations in the static and dynamic positions of the system, when infeeding forces from the tractors 18 and 20 pull the paper from the roll 32 (dynamic position) and when the pulling on the web is stopped (static position). In these positions and in moving between them, the roll and roller contact along a line of contact which parallels the axis of rotation 36 of the roll 32 and the axis of rotation 52 of the roller 50. These lines of contact are spaced from each other along the periphery of the roller 50 and the angle between them is illustrated as angle (a) in FIG. 2.

The roll is supported so that is can execute limited pivotal and translational movement as the pulling forces are applied and released. This support is provided by a shaft 58 which extends through the central opening 34 in the roll 32. The shaft 58 also extends through slots 60 and 62 in the opposite walls 22 and 24 of the frame 14. These slots are open at the top and tapered to a wider opening at the top whereof so as to facilitate removal of spent rolls and replacement with fresh rolls. These slots extend downwardly along a plane 64 generally paralleling the axes 36 and 52 of rotation. The plane 64 extends generally radially of the roller 50. It is slightly offset from the axis 52 in a preferred embodiment of the invention. The lower portions 66 of the slots capture the shaft 58. They are approximately equal to the diameter of the shaft with sufficient tolerance to enable a shaft to move along the slot with the center of the shaft 58 being in the plane 64. To prevent translational movement in the direction of the axis 36, caps 68 and 70 may be attached to the ends of the shaft 58. If the caps are of a diameter less than the diameter of the central opening 34 they may be permanently fixed on the ends of the shaft 58. Otherwise they may be removable with a friction or press-type fit after the shafts are passed through the central opening 34.

Removal and installation of rolls is a simple operation which involves merely the insertion and removal of the shafts and dropping them into the slots 60 and 62 with the roll 32 between the walls 22 and 24. Once between the walls, the roll 32 may be shifted laterally and aligned with the tractors 18 and 20. The lids 40 of the tractors 18 & 20 are open during loading and unloading and are closed after the pins 44 are placed in the perforations. The slots and the plane 64 are preferably tilted at an acute angle between 5° and 45°, with approximately 15° being preferable, to the vertical. The slots may be vertical and the plane may be through the axis 52 of the roller 50. The tilted orientation is preferred since it precludes jitter and restrains movement of the roll 32 and shaft 58 in a direction along the vertical.

In the static position, the roll is located as shown in FIG. 2 with its axis 36 tilted to the left of the slots 60 and 62. When infeeding or pulling forces are applied to the paper 30. The roll 32 rotates in a clockwise direction as shown in FIG. 3. The moment of the force applied to the roll is such that the roll pivots about the roller 50 and about its own center. The roll climbs the roller 50 storing energy in the process. The roll stays in the dynamic position (FIG. 3) so long as pulling forces are applied to the paper 30. When the pulling forces are released the stored energy is released and the roll 32 rotates down the periphery of the roller 50 back to the static position. Between the static and dynamic positions (FIG. 4) the roll pivots while translating downwardly. This motion results in a counterclockwise rotation of the roll as shown in FIG. 4. With the counterclockwise rotation, a backspin rather than an overspin occurs. Back tension is applied to the web in the direction shown by the arrow 70 in FIG. 4. The web is always maintained in tension whether in dynamic or static position or therebetween. Also the web exits tangent from the point of contact between the roll and the roller which is essentially along a straight path through the tractors 18 and 20 as shown in FIG. 3.

From the foregoing description it will be apparent that there has been provided an improved system for dispensing webs from rolls on which they are wound. The system avoids the need for additional drag on the web and automatically maintains tension on the web both during feeding and when feeding stops and the infeeding forces which pull the web from the roll are released. Variations and modifications in the herein described system will undoubtedly suggest themselves to those skilled in the art. Accordingly, the foregoing description should be taken as illustrative and not in a limiting sense.

I claim:

1. The method of unreeling a web wound onto a roll having a central axis while continuously maintaining tension on said web, even when unreeling stops, which method comprises the steps of supporting said roll on a rotatable body which contacts the outer periphery of said web wound on the roll at a point on the periphery of said body so that said body rotates with said roll as said web is pulled from said roll, guiding said roll for limited pivotal movement having a displacement component upwardly along the periphery of said body when pulling force is applied to said web and a downward component of motion when pulling force is released thereby applying tension on said web in the direction opposite to the direction of said pulling force when said pulling force is released, wherein said supporting step is carried out with a cylindrical body and said roll makes a line contact with said body, and wherein said guiding step is carried out with a shaft extending through a central opening in said roll, having a diameter which is larger than said shaft in diameter and with spaced walls having slots open at their top, and placing said roll between said walls with said shaft in said slots.

2. The method according to claim 1 wherein said supporting step is carried out by disposing said slots tilted at an acute angle to the vertical.

3. The method according to claim 1 wherein said web is edge perforated continuous paper, and further comprising the step of applying said pulling force intermittently to pull and release said paper with tractors which engage said perforations.

4. Apparatus for unwinding a web wound into a roll having a central opening along the axis of said roll which comprises a rotatable body on which said roll rests and which rotates with said roll when said roll rotates, means supporting said roll for limited combined pivotal and translational movement about said body, means for applying pulling force in one direction to said web to unwind said web and cause said roll to climb a distance along said body while executing said pivotal movement and said translational movement in an upward direction whereby when said pulling force is released said roll executes pivotal and translational movement in a direction to wind said web back on said roll thereby maintaining tension on said web, wherein said body is a cylindrical roller having an axis of rotation extending generally parallel to the axis of said roll, and wherein said supporting means comprises walls spaced apart a distance greater than the width of said web, slots in said walls open at the top thereof, a shaft of diameter smaller than the diameter of said central opening and longer than the width of said web, and said shaft being disposed in said slots.

5. The apparatus according to claim 4 wherein said slots are disposed so that a plane extending through said slots extends through said roller in a direction generally radially of said roller.

6. The apparatus according to claim 5 wherein said slots in portions thereof at least in a region between said central axis and said roller are approximately equal in width to the diameter of said shaft so that said shaft can translate along said slots.

7. The apparatus according to claim 6 wherein said shaft has caps of larger diameter than said slots on the opposite sides of said walls from said roll for restraining axial movement of said shaft.

8. The apparatus according to claim 7 wherein said plane is inclined at an acute angle to the vertical.

9. The apparatus according to claim 8 wherein said angle is from about 5° to 45°.

10. The apparatus according to claim 9 wherein said angle is about 15°.

* * * * *